United States Patent [19]

May et al.

[11] 4,447,343

[45] May 8, 1984

[54] CONCENTRATED FABRIC SOFTENERS

[75] Inventors: Adolf May, Hofheim am Taunus; Hans-Walter Bücking, Kelkheim, both of Fed. Rep. of Germany

[73] Assignee: Hoechst Aktiengesellschaft, Fed. Rep. of Germany

[21] Appl. No.: 448,296

[22] Filed: Dec. 9, 1982

[30] Foreign Application Priority Data

Dec. 18, 1981 [DE] Fed. Rep. of Germany ..... 3150178

[51] Int. Cl.[3] ..... D06M 13/30; D06M 13/46

[52] U.S. Cl. ..... 252/8.75; 252/8.7; 252/8.8

[58] Field of Search ..... 252/8.7, 8.75, 8.8

[56] References Cited

U.S. PATENT DOCUMENTS

| | | | |
|---|---|---|---|
| 3,954,634 | 5/1976 | Monson et al. | 252/8.75 |
| 3,997,453 | 12/1976 | Wixon | 252/8.75 |
| 4,264,457 | 4/1981 | Beeks et al. | 252/8.75 |
| 4,267,077 | 5/1981 | Niimi et al. | 252/8.75 |

*Primary Examiner*—Maria Parrish Tungol

*Attorney, Agent, or Firm*—Connolly and Hutz

[57] ABSTRACT

Transparent, liquid fabric softener concentrates consisting substantially of (a) from 26 to 40 weight % of a cationic softener, (b) from 0.01 to 8, weight % of an anionic surfactant, (c) from 0.01 to 8, weight % of a nonionic dispersant, (d) from 3 to 30, weight % of a $C_1$–$C_3$ alcohol, and (e) water, optionally perfume, dyestuffs and other auxiliaries in amounts remaining to complete to 100%.

7 Claims, No Drawings

CONCENTRATED FABRIC SOFTENERS

It is known that textiles which have been washed, especially in an automatic washer, and particularly those made from cellulose fibers, are in an unpleasant hardened state after drying. This undesirably hardened feel can be overcome by treating the textiles after washing in a rinsing bath with cationic substances which contain at least two long-chain aliphatic radicals in the molecule. Especially the dialkyldimethylammonium salts or imidazole derivates of the formulae I to III

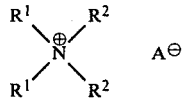

(I)

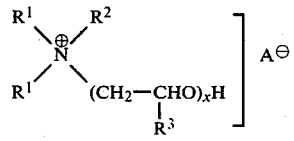

(II)

are used in the practice for this purpose.

In these formulae, $R^1$ is alkyl or alkenyl having from 8 to 22, preferably 16 to 18, carbon atoms, $R^2$ is alkyl having from 1 to 4 carbon atoms, preferably methyl, $R^3$ is methyl or hydrogen, x is a number of from 1 to 5 and A is an anion such as $Cl^{(-)}$, $Br^{(-)}$, $CH_3OSO_3^{(-)}$ or $CH_3OPO_3^{(-)}$.

Aqueous dispersions of the above raw materials have the disadvantage of a turbid, milky appearance while formulations are required which in their aqueous concentrated form are transparent. Furthermore, the mixtures must be well dispersible in cold water. Other requirements are: no thickening of the formulation on storage, stability after prolonged storage, no formation of bottom sediments. It has now been found that these requirements can be met when adding a certain amount of anionic surfactants to the compounds of the above formulae.

Subject of the invention are therfore concentrated fabric softeners consisting substantially of (a) from 26 to 40, preferably 26 to 30, weight % of a compound of the formulae

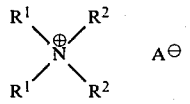

(I)

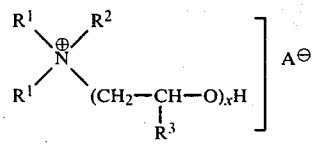

(II)

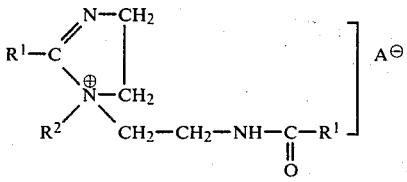

(III)

in which $R^1$ through $R^3$, x and A are as defined above, (b) from 0.01 to 8, preferably 1 to 3, weight % of an anionic surfactant, (c) from 0.01 to 8, preferably 0.5 to 3, weight % of a non-ionic dispersant, (d) from 3 to 30, preferably 5 to 15, weight % of a $C_1$–$C_3$-alcohol, and (e) water, optionally perfume, dyestuffs and other auxiliaries in amounts remaining to complete to 100%.

Suitable anionic surfactants are especially the compounds of the following formulae IV to VII

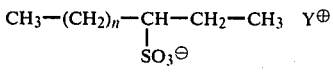

IV

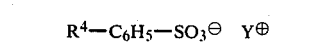

V

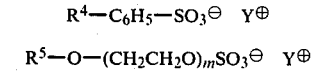

VI

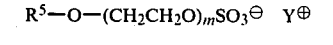

VII in which $R^4$ through $R^6$ each are alkyl having from 8 to 20, preferably 10 to 15, carbon atoms, n is a number of from 8 to 18, preferably 11 to 14, m is a number of from 0 to 5, preferably 3, and Y is Na, K or $NH_4$.

The fabric softener concentrates according to the invention contain furthermore customary nonionic dispersants or emulsifiers based on oxyalkylates which contribute to making the concentrate easily dispersible in cold water. Examples of suitable nonionic dispersants are reaction products of about 2–15 mols of ethylene oxide each with an alkylphenol, such as xylenol, or with an alkylphenol having a long alkyl radical with 8–10 carbon atoms, or with a fatty alcohol having 8 to 15 carbon atoms, in particular reaction products of about 5 to 8 mols of EO with 1 mol of alkylphenol or 1 mol of a fatty alcohol containing 8 to 15 carbon atoms or a mixture of fatty alcohols of this type.

When preparing the concentrated fabric softeners of the invention, the cationic softening compounds of the formulae I to III are advantageously used in the form of concentrated solutions in lower alcohols, preferably isopropanol, or a mixture of such alcohols with water. Therefore, the fabric softeners of the invention contain a certain amount of such lower alcohols. The concentrated fabric softeners of the invention may also contain further substances and auxiliaries which are either mixed already with the concentrate of the fabric softener or are added separately to the ready-to-use dilute composition. These are substances or auxiliaries which are conventionally used in softening compositions; they include, for example, cationic and nonionic surface-active substances, electrolytes, neutralizing agents, organic complexing agents, optical brighteners and solubilizers, as well as dyestuffs and perfumes. Additives of the kind serve, for example, to further influence the feel of the fabric or other properties of the textile goods to be treated, or the adjustment of the viscosity or pH or further promote the stability of the solutions at low temperatures.

The concentrated fabric softeners of the invention impart a pleasant and soft feel to any textile material, especially those made from natural or genenerated cellulose, wool, cellulose acetate, cellulose triacetate, polyamide polyacrylonitrile, polyesters, or polypropylene. Especially advantageous is its use for the after-treatment of terry fabrics and underwear. These fabric softener mixtures are prepared by simply mixing or dispersing the individual components in water. They may contain one compound each of the formulae I to III or IV to VII, or a mixture of two or more compounds of these formulae within the ranges as indicated. In the case of a mixture of two or more compounds of the formulae I to III or IV to VII, the mixing ratio thereof with one another is not at all critical and may have any value.

The fabric softenre concentrates are applied as usual, that is, they are added to the last rinsing water after the washing operations are complete. The textiles so treated are subsequently dried.

The above fabric softener concentrates having good softening properties are completely transparent. They are distinguished by a good stability, and their dispersibility in cold water is excellent. Gel formation was not observed. Even in a highly concentrated form, the formulations have a low viscosity. Thickening or gelling after prolonged storage does not occur.

Furthermore, an improved feel was observed, so that surprisingly the anionic surfactant acts not only as emulsifier but also as softening component. Alone, anionic surfactants have no softening effect, because they are not absorbed by the fabric.

In the following Examples, some fabric softeners of the invention are described. Percentages are by weight in all cases. The softeners have been prepared in all cases by simply stirring aqueous solutions of the individual components with one another in cold state.

EXAMPLE 1

Di-tallow fatty alkyldimethylammonium chloride—26%
sec. alkanesulfonate $C_{13}$–$C_{15}$—2.5%
nonylphenol with 9 EO—3%
isopropanol—10%
perfume—0.5%
water, dyestuff—to 100%
Apppearance: transparent liquid; can be well diluted with cold water.

EXAMPLE 2

Di-tallow fatty alkylmethyloxypropylammonium chloride—30%
$C_{12}$–$C_{14}$-alkyl—O—$(CH_2—CH_2—O)_3SO_3Na$—5%
$C_{12}$—$C_{15}$-alcohol+10 EO—5%
ispropanol—17%
perfume—0.8%
water, dyestuff—remainder to 100%
Appearance: transparent liquid; can be well diluted with cold water.

EXAMPLE 3

Di-tallow fatty alkylimidazolinium methosulfate—28%
$C_{12}$-alkylsulfate—4%
isotridecyl alcohol+8 EO—4%
ispropanol—15%
perfume—1%
water, dyestuff—remainder to 100%
Appearance: transparent liquid; can be well diluted with cold water.

EXAMPLE 4

Di-tallow fatty alkyldimethylammonium chloride—27%
$C_{12}$–$C_{15}$-alkylbenzenesulfonate—3%
nonylphenol+10 EO—3%
ispropanol—15%
perfume—0.5%
water, dyestuff—to 100%
Appearance: transparent liquid; can be well diluted with cold water.

EXAMPLE 5

Di-tallow fatty alkyldimethylammonium chloride—35%
$C_{15}$–$C_{18}$-olefinsulfonate—5%
$C_{12}$–$C_{15}$-alcohol+11 EO—4%
ispropanol—10%
perfume—0.8%
water, dyestuff—to 100%
Appearance: transparent liquid; can be well diluted with cold water.

What is claimed is:

1. Transparent, liquid fabric softener concentrates consisting substantially of (a) from 26 to 40 weight % of a cationic softener,
(b) from 0.01 to 8 weight % of an anionic surfactant,
(c) from 0.01 to 8 weight % of a nonionic dispersant,
(d) from 3 to 30 weight % of a $C_1$–$C_3$ alcohol, and
(e) water in an amount remaining to complete to 100%.

2. Fabric softener concentrates as claimed in claim 1, which consist substantially of (a) from 26 to 40 weight % of a cationic softener of the formulae

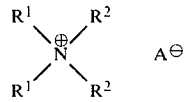

(I)

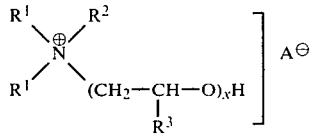

(II)

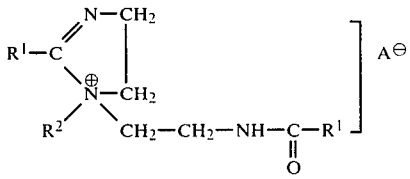

(III)

in which $R^1$ is alkyl or alkenyl having from 8 to 22, carbon atoms, $R^2$ is alkyl having from 1 to 4 carbon atoms, $R^3$ is methyl or hydrogen, x is a number of from 1 to 5 and A is an anion such as $Cl^{(-)}$, $Br^{(-)}$, $CH_3OSO_3^{(-)}$ or $CH_3OPO_3^{(-)}$, (b) from 0.01 to 8 weight % of an anionic surfactant of the formulae IV to VII

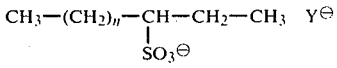

(I)

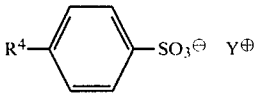

(II)

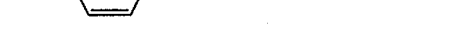

(III)

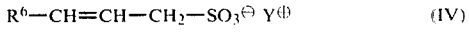

(IV)

in which $R^4$ through $R^6$ each are alkyl having from 8 to 20, carbon atoms, n is a number of from 8 to 18, m is a number of from 0 to 5, and Y is Na, K or $NH_4$, (c) from 0.01 to 8 weight % of an oxethylated alkylphenol or fatty alcohol, (d) from 3 to 30 weight % of a $C_1$–$C_3$-alkanol, and (e) water in an amount remaining to complete 100%.

3. Fabric softener concentrates as claimed in claim 1, which consist substantially of from 26 to 30 weight % of component (a), from 1 to 3 weight % of component (b), from 0.5 to 3 weight % of component (c), from 5 to 15 weight % of component (d), and water in an amount remaining to complete 100%.

4. Fabric softener concentrates as claimed in claim 1, wherein said concentrates include auxiliaries including perfume and dyestuffs.

5. Fabric softener concentrates as claimed in claim 2, wherein $R^1$ is alkyl or alkenyl having from 16 to 18 carbon atoms; $R^2$ is methyl; $R^4$ through $R^6$ each are alkyl having from 10 to 15 carbon atoms; n is a number from 11 to 14; and m is 3.

6. Fabric softener concentrates as claimed in claim 2, wherein said concentrates include perfume, dyestuffs, and other auxiliaries.

7. Fabric softener concentrates as claimed in claim 3, wherein said concentrates contain perfume and dyestuffs.

* * * * *